US006607348B2

(12) United States Patent
Jean

(10) Patent No.: US 6,607,348 B2
(45) Date of Patent: Aug. 19, 2003

(54) GAS COMPRESSOR

(75) Inventor: Pierre Jean, Le Habre (FR)

(73) Assignee: Dresser-Rand S.A., Le Havre (FR)

( * ) Notice: Subject to any disclaimer, the term of this patent is extended or adjusted under 35 U.S.C. 154(b) by 166 days.

(21) Appl. No.: 09/879,871

(22) Filed: Jun. 5, 2001

(65) Prior Publication Data

US 2002/0031437 A1 Mar. 14, 2002

Related U.S. Application Data

(63) Continuation of application No. PCT/EP99/09516, filed on Dec. 6, 1999.

(30) Foreign Application Priority Data

Dec. 10, 1998 (EP) ..... 98403124

(51) Int. Cl.[7] ..... F04D 29/12; F04D 29/14

(52) U.S. Cl. ..... 415/1; 415/104; 415/106; 415/112; 415/113; 415/230; 415/231; 277/408; 277/431

(58) Field of Search ..... 415/1, 104, 106, 415/112, 113, 174.2, 230, 231; 277/408, 431, 432

(56) References Cited

U.S. PATENT DOCUMENTS

| | | | | |
|---|---|---|---|---|
| 3,420,434 A | | 1/1969 | Swearingen | |
| 5,421,593 A | | 6/1995 | Aritsubo et al. | |
| 5,718,560 A | * | 2/1998 | Lorenzen | 415/112 |

FOREIGN PATENT DOCUMENTS

| | | |
|---|---|---|
| DE | 42 25 642 C1 | 7/1993 |
| EP | 0 361 844 | 4/1990 |
| WO | WO/91/14853 | 10/1991 |

* cited by examiner

*Primary Examiner*—Christopher Verdier
(74) *Attorney, Agent, or Firm*—Haynes and Boone, LLP.

(57) ABSTRACT

To avoid formation of condensate or freezing in the tandem gas seals (12, 13) of a gas compressor (1), such as for use in the compression of production of natural gas, when the compressor is temporarily stopped for maintenance or repair of the compressor or instrumentation, the settle out pressure (SOP) in the high pressure gas discharge line (7) from the compressor (1), arising from equalising the inlet and outlet gas pressures, is directed to cause gas to flow through a branch line (25) to the outboard gas seal (13), the gas being heated by an electrical heating coil (28) and its pressure being reduced in a controlled manner. In this way, the gas is prevented from entering its liquid-vapor phase, so that no condensate can form in the inboard and outboard gas seals (12, 13).

9 Claims, 3 Drawing Sheets

GAS COMPRESSOR

This is a continuation of PCT/EP99/09516 filed Dec. 6, 1999.

This invention relates to a gas compressor and finds particular, though not exclusive, application to gas liquefaction, e.g. liquified nitrogen gas, ethylene and ammonia, refining, gas production and gas reinjection for enhanced oil production.

By way of background prior art, reference is directed to U.S. Pat. No. 3,420,434 and U.S. Pat. No. 5,421,593.

The problem that the present invention solves will now be described with reference to FIGS. 1 and 2 of the accompanying drawings. In FIG. 1, there is shown a conventional system including gas compressor 1 used for compressing natural gas, for example from a gas production field. For simplicity, the portion of the compressor located below the axis of its main shaft 2 is indicated diagrammatically, whereas the portion above the shaft axis is depicted in some detail.

The compressor 1 has a main housing 3, a gas inlet 4, a delivery line 5 delivering production gas at production pressure (low pressure) to the compressor inlet 4, and a gas outlet 6 discharging compressed (high pressure) gas along gas discharge line 7. Within the housing 3 are successive, axially separated, gas compression stages or impellers. In FIG. 1 are shown, by way of example, three compression stages 1*a,* 1*b,* 1*c,* but it is to be understood that any number of such stages may be used. Typically, the compressor will have between one and ten gas compression stages. The compression stages 1*a,* 1*b,* 1*c* progressively compress the low-pressure inlet gas, for discharge from the compressor as high-pressure gas.

As is well-known in the art, the compressor comprises a balance drum 8 with associated labyrinth seal 8*a,* separating the high-pressure region within the compressor housing from a balance chamber 9, which is maintained at the same pressure as the inlet pressure to the compressor. For this purpose, a pressure equalization line 10 connects the compressor inlet 4 to the balance chamber 9, as diagrammatically depicted in FIG. 1. By means of this standard arrangement, net axial force acting on the compressor rotor in either axial direction can be significantly reduced, there being a double effect thrust bearing (not shown for simplicity) at the inlet end of the compressor for withstanding such reduced axial force, in whichever direction it acts.

The main shaft is supported at each end by a sealing arrangement which will now be described. Only the sealing arrangement at one end, i.e. that where the balance chamber 9 is located, will be described, but it will be appreciated that the description applies correspondingly to the sealing arrangement at the second end.

As shown, a labyrinth shaft seal 11 is provided adjacent the balance chamber 9, but is not sufficient in itself to provide a sufficiently effective and reliable seal. Accordingly, an additional shaft sealing arrangement is provided by tandem inboard and outboard gas seals 12, 13 respectively. Such seals are well known in the art and need not be further described herein. By way of example, the seals may be constructed in accordance with the disclosure of International Patent Applications PCT/IB94/00379, PCT/GB96/00939 or PCT/GB96/00940, all belonging to the present applicants.

An inlet port 12*a* of inboard gas seal 12 is supplied with gas by the delivery gas pressure in gas discharge line 7, by way of a branch line from discharge line 7 comprising a common line 14 and a branch section 15. The common line 14 also supplies gas to the inboard gas seal at the other end of the compressor in corresponding fashion. Each outboard seal 13 has an inlet port 13*a* which, as shown, is blocked off. Alternatively, no inlet port is provided at all. A filter system 16 is incorporated in line 14 for removing solid and liquid particulates from the high-pressure gas flow and thereby cleans the gas before it reaches the tandem gas seals (12, 13). The outboard face of labyrinth seal 11 communicates via a small gap between the stationary and moving parts of gas seal 12 with the gas pressure at the port 12*a,* which is slightly above the pressure (compressor inlet pressure) in the balance chamber 9, so that there is a small flow of gas along this route, past the labyrinth seal 11, between the seal and shaft surface, and into the interior of the compressor. The remainder of the gas entering port 12*a* flows through the inboard gas seal 12 and arrives in a gas chamber 17 between the inboard and outboard seals 12, 13, a proportion of this gas being conveyed from this chamber 17 to a discharge line 18 leading to a flare system, which burns the discharged gas. The flare system operates at a pressure slightly above atmospheric pressure, say a few hundred millibars (e.g. 0.2 to 0.3 bar above atmospheric pressure).

The remaining proportion of gas in chamber 17 passes through the sealing region of gas seal 13, from where it is conveyed along discharge line 19 to an atmospheric vent system.

The compressor system also includes various control valves, specifically an automatic on/off valve 20 connected in gas delivery line 5, a further automatic on/off valve 21 connected in gas discharge line 7, and a control valve 22 connected in common line 14. The function of control valve 22 is, under normal operation, to reduce the gas discharge pressure in line 7 to a pressure just above that in line 5 and also to reduce the flow rate (and thereby increase the gas residence time in the filter), so as to ensure adequate filtering performance. Automatic on/off valves 20, 21 are operated from a central control panel. In addition, an anti-surge valve 32 and cooler 33 are included in a bypass line 31, connecting delivery line 5 to discharge line 7. The anti-surge valve 32 is responsive to the inlet flow through line 5 so as to open when the gas flow falls to a predetermined value, say 70% of nominal flow, below which there would be a risk of compressor operation becoming unstable (surging) due to reverse flow through the compressor, in turn causing shaft vibration. When the anti-surge valve is open, the cooler 33 serves to cool the gas passing through connecting line 31 from its high pressure end to its low pressure end, to keep the gas inlet temperature to the compressor at an acceptable level. The compressor operates as follows.

In normal operation when the compressor is running, on/off valves 20, 21 are both open and anti-surge valve 32 is closed. The compressor 1 compresses the low-pressure inlet gas in its successive stages and delivers high-pressure gas through gas discharge line 7. A proportion of this gas is branched off through common line 14 and solid and liquid particles in the line are removed by filter system 16. The gas pressure in common line 14 is then reduced by control valve 22 to a value just slightly above the gas inlet pressure to the compressor. This establishes the sealing pressure (SP) of the inboard gas seal 12.

Referring now to FIG. 2, this is a pressure-enthalpy diagram, from which the operation of the compressor will be understood. The sealing pressure of the inboard gas seal 12 is denoted by the value "SP" on the pressure abscissa. Because this sealing pressure is very slightly larger than the inlet pressure maintained in balance chamber 9, there will be a small flow of gas from the outboard side of labyrinth seal 11 to the inboard side, typically 1% of the compressor delivery. The remaining proportion of the gas passes through the inboard gas seal 12 to gas chamber 17, from where a proportion of the gas passes to flare and the remainder flows, via second gas seal 13, to vent, as described above.

In FIG. 2, the inlet gas pressure or sealing pressure SP to the gas seal 12 of the gas sealing arrangement is indicated by operating point A, that in the region of the inboard seal 12 communicating with gas chamber 17 being denoted by B and that in the region of the outboard gas seal 13 communicating with the vent line 19 by C. The reason why the enthalpy of the gas flow increases when passing from operating point A to operating point B and when passing from operating point B to operating point C is that the gas becomes heated due to internal frictional forces acting as the gas passes through the inboard and outboard seals. The gas passing through vent line 19 is at atmospheric pressure, ATM.

In FIG. 2 the phase boundary of the liquid-vapour phase of the hydrocarbon gas is shown at PB. Since the operating lines A–B, B–C do not cross the phase boundary PB, the gas remains in its gaseous phase. Therefore, there is no possibility of any condensate forming in the gas seals.

However, it is occasionally necessary to take the compressor out of service temporarily, such as for maintenance or repair of the compressor and its instrumentation. When this is to happen, valves 20 and 21 are closed first, and then anti-surge valve 32 opens to equalize the supply and delivery pressures and thereby reduce the pressure in gas discharge line 7 to a residual delivery gas pressure, commonly known as the settle out pressure (SOP). Because of the reduced pressure, the gas flow through control valve 22 is significantly reduced, which in turn reduces the pressure drop across it to a value approaching zero. Accordingly, the settle out pressure SOP is present as the inlet pressure to inlet port 12*a* to inboard seal 12 (operating point D in FIG. 2). Gas flow into seal 12, when the compressor is under SOP, is via two routes, i.e. through labyrinth seal 11 and inlet port 12*a*, the gas passing into gas chamber 17, from where the gas mixture flows partly to flare and partly to vent, as described above. Because the gas flow velocity through the inboard gas seal 12 is very low, minimal heat is generated by internal frictional forces acting on the gas in the sealing arrangement. Therefore, the enthalpy value of the gas, as it passes successively through the inboard seal 12 and gas chamber 17 either to flare or, via outboard seal 13, to vent, remains substantially constant. As a result, the gas pressure having the settle out pressure at the inlet port 12*a* falls by a large amount to an intermediate pressure value in the region of inboard seal 12 communicating with gas chamber 17, this intermediate pressure being that of the flare system which is at slightly above atmospheric pressure (operating point E), and by a smaller amount in outboard seal 13 to atmospheric pressure in the region of that seal in communication with vent line 19 (operating point F). Since the operating line D–E, E–F intersects the phase boundary PB and enters the liquid-vapour phase region, condensate will form in the two gas seals 12, 13. This condensate enters the gas sealing regions of the gas seals. Then, when the compressor is re-started, instead of there being the intended gas film in the gas seals which provides the required sealing effect with very low frictional force, the condensate in the seals prevents them from working in the intended manner and they generate large frictional resistance, which in turn causes damage to the seals.

The present invention seeks to solve this problem by preventing the formation of condensate in the inboard and outboard gas seals of the sealing arrangement.

The present invention, in common with the compressor described with reference to FIG. 1, provides a gas compressor having a main housing, a main shaft extending through said housing at one end thereof, a low pressure gas inlet, a high pressure gas outlet, and inboard and outboard tandem gas seals for the main shaft at said one end of the compressor housing, said inboard gas seal having an inlet connected to receive a sealing pressure maintained by the delivery pressure of the compressor.

The invention is characterized by means operative, when the gas compressor is temporarily stopped and its inlet and outlet pressure are equalized, to provide a residual delivery gas pressure, to connect an inlet of said outboard gas seal to receive the residual delivery gas pressure and to reduce the pressure of a mixture of the gases that have passed through the inboard and outboard seals and further characterized by heating means for raising the temperature of the gas flow, produced by said residual delivery gas pressure, to the outboard gas seal, to prevent formation of condensate or freezing in the inboard and outboard gas seals.

So long as the heating of the gas flow delivered to the outboard seal is sufficient to prevent the gas entering its liquid-vapour phase as it passes through the gas seals, there will be no possibility of any condensate forming, or freezing occurring. Therefore, the gas seals will operate as designed and without damage, when the compressor is re-started.

It is remarked that it would not be an adequate solution to the problem, solely to raise the temperature (and therefore enthalpy) of the gas entering the inboard seal alone in the compressor arrangement described with reference to FIGS. 1 and 2. The reason is that the heat transferred to the gas, which has a relatively low flow rate, would be rapidly absorbed by the high thermal capacity of the inboard and outboard gas seals, resulting in the gas entering its liquid-vapour phase while still in the seals, thereby leading to the formation of condensate. In addition, the (relatively cool) gas flow from the compressor past the labyrinth seal 11 would mix with and thereby cool the gas flow passing through the inboard seal along line 15. By contrast, because, with the compressor to be described below, there is a higher gas low rate through the outboard seal due to its lower discharge pressure (atmospheric pressure) and the existence of two gas discharge routes, the elevated temperature of the gas can be maintained sufficiently throughout its passage through the sealing arrangement to prevent the formation of condensate either in the inboard seal or in the outboard seal.

In accordance with a simple and effective constructional arrangement, the inlet of the outboard gas seal is connected via a branch line from a high pressure gas discharge line connected to the compressor outlet, said branch line including a first on-off valve and said heating means being located in thermal communication wish said branch Line. A control valve may be included in the branch line and is set to reduce the gas pressure to a value lower than the residual gas pressure. Providing the reduced gas pressure is high enough such that the gas remains outside its liquid-vapour phase boundary, no condensate can form.

Preferably a second on-off valve is provided in a line leading from a gas chamber, communicating between the inboard and outboard seals, to flare, and a throttle element is connected in parallel with said second on-off valve. The second on-off valve is in its open condition during normal operation. However, when the compressor is stopped, this valve is shut off to divert the flow through the throttle element, which serves both to help conserve the residual gas pressure in the high pressure gas discharge line by limiting the gas flow and to maintain elevated pressure in the gas chamber between the two seals, as well as in the regions of the two seals communicating with that chamber.

The invention also provides a method of operating a gas compressor having a main housing, a main shaft extending through said housing at one end thereof, a low pressure gas inlet, a high pressure gas outlet, and inboard and outboard tandem gas seals for the main shaft at said one end of the compressor housing, wherein, in normal operation of the gas compressor, gas at sealing pressure is supplied by the delivery pressure of the compressor to the inboard gas seal and, when the gas compressor is temporarily stopped and the inlet and outlet pressures are equalized to provide a residual delivery gas pressure, gas supplied by the residual delivery gas pressure of the compressor is introduced into the outboard gas seal under conditions of temperature and pressure such as to prevent formation of condensate or freezing in the inboard and outboard gas seals.

Preferably, the gas introduced into the outboard gas seal when the gas compressor is temporarily stopped is heated to raise its temperature. The gas pressure may be reduced from its residual delivery gas pressure before it is introduced into the outboard gas seal.

In accordance with one preferred way of implementing the method, a gas flow to flare from a gas chamber between the inboard and outboard seals is throttled to maintain elevated gas pressure in said gas chamber.

For a better understanding of the invention and to show how the same may be carried into effect, reference will now be made, by way of example, to the accompanying drawings, in which.

Figure 1:
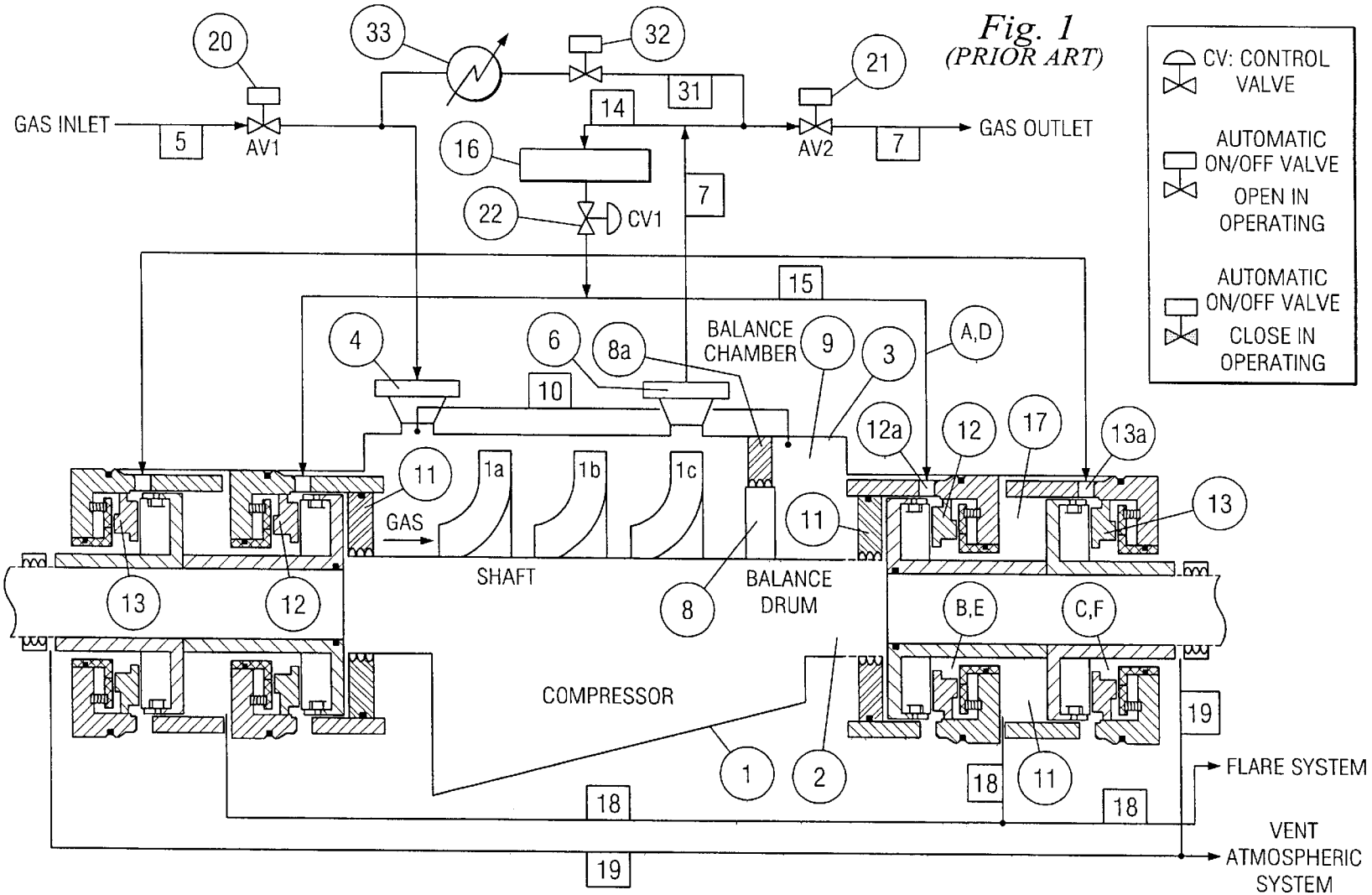
Fig. 1 (PRIOR ART)
FIG. 1 is a diagrammatic view of a known gas compressor with associated operating elements, for compressing production hydrocarbon gas.
Figure 2:
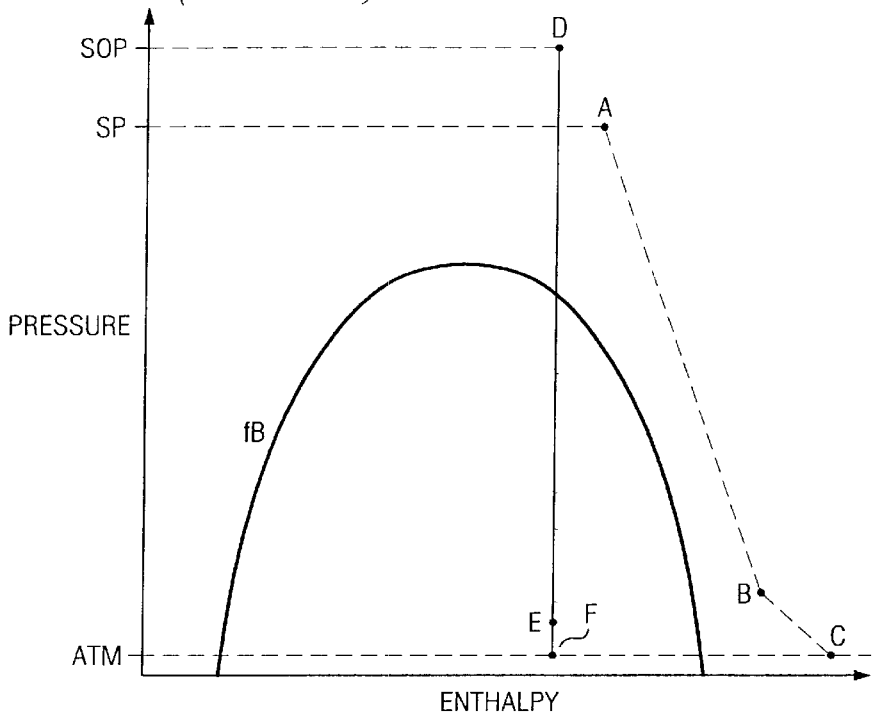
Fig. 2 (PRIOR ART)
FIG. 2 is a pressure-enthalpy diagram relating to the operation of the gas compressor.
Figure 4:
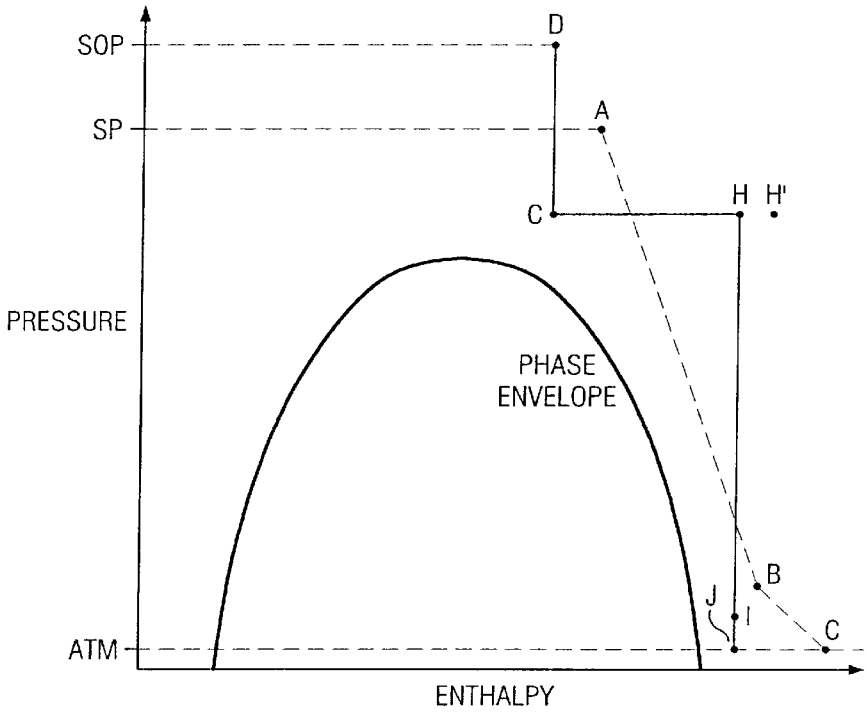
FIG. 4 is a pressure-enthalpy diagram illustrating its manner of operation.
Figure 3:
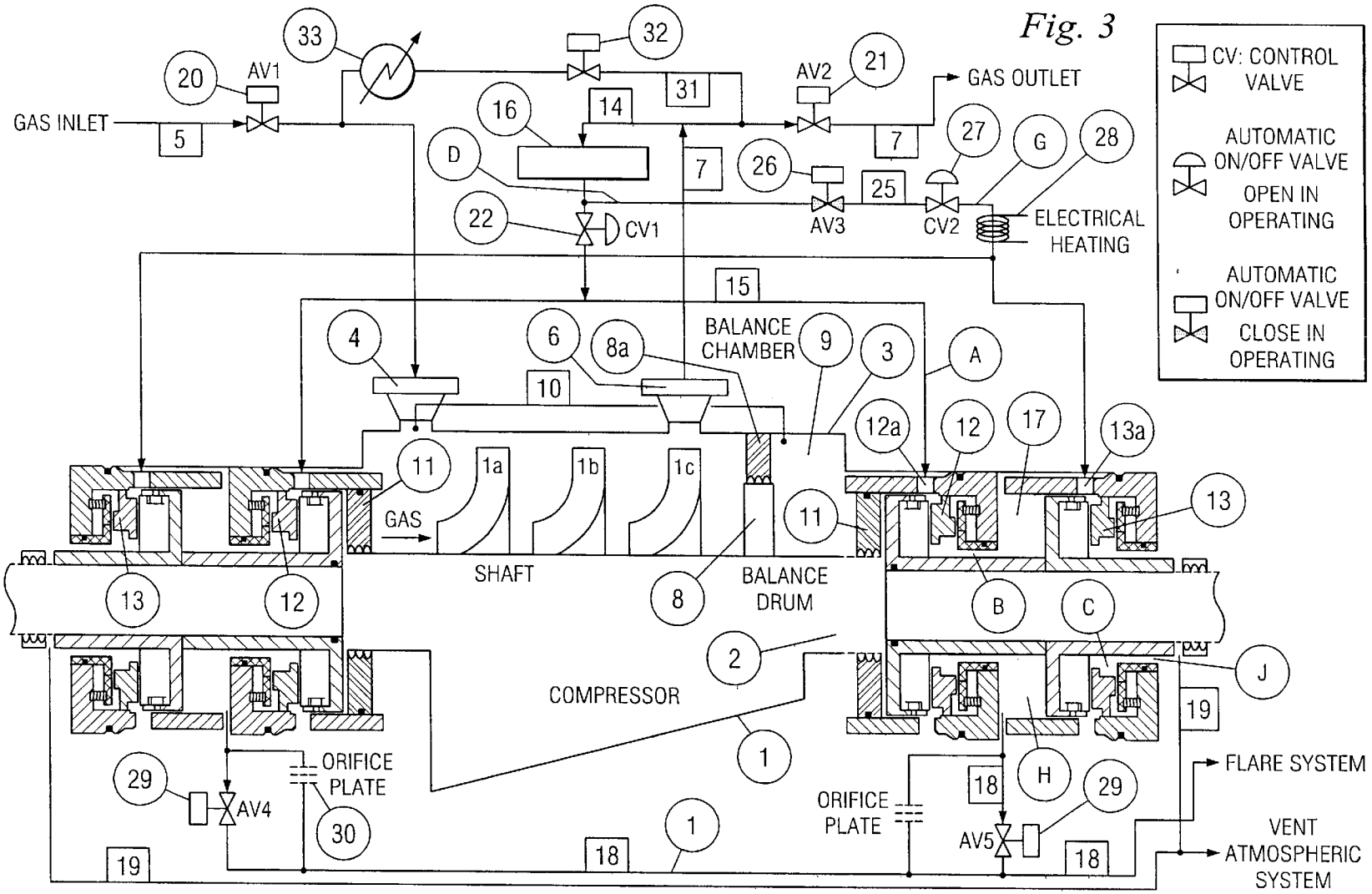
FIG. 3 is a diagrammatic representation of an embodiment of the present invention.

In FIGS. 3 and 4 corresponding elements to those described with reference to FIGS. 1 and 2 are denoted by the same reference numerals or reference characters and will therefore not be further described.

As shown in FIG. 3, a further branch line 25 starts from a point in common line 14 between filter system 16 and control valve 22 and leads to inlet port 13*a* of each outboard gas seal 13. Connected in this branch line are an automatic on/off valve 26, which is closed when the compressor is operating, a control valve 27 and an electrical heating coil 28. Valve 27 and coil 28 can be provided in branch line 25 in either order.

In addition, an automatic on/off valve 29 is connected in discharge line 18 and a throttle element in the form of an orifice plate 30 is connected in parallel with valve 29.

The operation of the gas compressor will now be described with reference to FIG. 4. In the case of normal operation, i.e. when the compressor is running, the gas seal system operates along operating line A–B, B–C, exactly as in FIG. 2. This is because automatic on/off valve 26 is closed during normal operation.

However, when the compressor is stopped, valves 20, 21 and 29 close and then valves 26, 32 open. The residual delivery gas pressure (SOP) in lines 15, 25, represented by operating point D in FIG. 4, causes gas to flow in branch lines 15, 25. The gas passing through seal 12 (coming from line 15 and past labyrinth seal 11) and into gas chamber 17 is at operating point G. The control valve 27 in line 25 reduces the gas pressure from the valve (SOP) by an amount determined by the setting of the control valve, to a lower pressure value. The gas is then heated by electrical heating coil 28 to raise its temperature, and the heated gas enters the inlet port 13*a* of gas seal 13 and flows to gas chamber 17, where its pressure has the value set by control valve 27 (operating point H'). The flow rate through inlet port 13*a* is higher than through inlet port 12*a*, because it passes partly through the outboard seal 13 to vent and partly through the orifice plate 30. In gas chamber 17, the gas flows from the inboard and outboard seals 12, 13 become mixed. The gas mixture in gas chamber 17 is represented in FIG. 3 by operating point H. The pressure of the gas leaving the gas chamber 17 is then reduced by orifice plate 30 to a pressure slightly above (a few to a few hundred millibars above) atmospheric pressure prevailing in discharge line 18 (operating point I). The gas leaving seal 13 and passing to vent at atmospheric pressure is represented by operating point J. The function of the orifice plate is to establish the operating point H at a suitable pressure level above atmospheric pressure, such that operating point G is not within the phase envelope PB. The size of the orifice in the orifice plate has to be selected to set the gas flow rate through gas chamber 17 such that the heat transfer to the gas seals does not cause the gas in the sealing arrangement to enter its liquid-vapour phase.

It will be seen from FIG. 4 that the operating line D–G, G–H, H–I remains outside the phase boundary of the liquid-vapour phase. Therefore, no condensate can form in the gas seals 12, 13.

It will be appreciated from the above description that the compressor described above with reference to FIG. 3 and its disclosed manner of operation avoid the possibility of condensate forming in the shaft sealing arrangement of the compressor, as well as the possibility of freezing. Furthermore, the technical solution merely involves the addition of relatively short lengths of pipe, a few control valves, an electrical heating coil and an orifice plate. Therefore, the technical solution is not expensive to implement. In addition, the additional structural elements can be added to an existing compressor such as disclosed in FIG. 1, without the need to install an entire new compressor system.

Although the embodiment disclosed with reference to FIG. 3 has inboard and outboard seals at each end of the compressor, it will be appreciated that in other embodiments such a shaft sealing arrangement may be provided at only one end.

By way of example, typical gas flow rates expressed in normal cubic meters per hour ($Nm^3/h$), i.e. at a pressure of 1 bar and ° C., and pressure (bars) under normal operation are given in the following table.

| Location | Gas flow rate ($Nm^3/h$) | Gas pressure (bar) |
|---|---|---|
| Line 5 | 111,000 | 180 |
| Line 14, between branch point for line 25 and valve 22 | 1,521 | 395 |
| Inlet port 12a | 760.50 | — |
| Labyrinth seal 11 | 734 | — |
| Line 7 | 111,000 | 395 |

What is claimed is:

1. A gas compressor having a main housing (3), a main shaft (2) extending through said housing at one end thereof, a low pressure gas inlet (4), a high pressure gas outlet (6), and inboard and outboard tandem gas seals (12, 13) for the main shaft at said one end of the compressor housing, said inboard gas seal having an inlet (12*a*) connected to receive a sealing pressure (SP) maintained by the delivery pressure of the compressor, characterized by means (25, 26, 30) operative, when the gas compressor is temporarily stopped and its inlet and outlet pressure are equalized, to provide a residual delivery gas pressure (SOP), to connect an inlet (13*a*) of said outboard gas seal to receive the residual delivery gas pressure and to reduce the pressure of a mixture of the gases that have passed through the inboard and outboard seals (12, 13) and further characterized by heating means (28) for raising the temperature of the gas flow, produced by said residual delivery gas pressure, to the outboard gas seal (13), to prevent formation of condensate or freezing in the inboard and outboard gas seals (12, 13).

2. A gas compressor according to claim 1, wherein the inlet (13*a*) of the outboard gas seal (13) is connected via a branch line (25) from a high pressure gas discharge line (7) connected to the compressor outlet (6), said branch line including a first on-off valve (26) and said heating means (28) being located in thermal communication with said branch line.

3. A gas compressor according to claim 2, wherein a control valve (27) is included in the branch line and is set to reduce the gas pressure to a value lower than the residual gas pressure (SOP).

4. A gas compressor according to claim 1, 2 or 3, wherein a second on-off valve (29) is provided in a line leading from a gas chamber (17), communicating between the inboard and outboard seals (12, 13), to a flare, and a throttle element (30) is connected in parallel with said second on-off valve (29).

5. A method of operating a gas compressor (1) having a main housing (3), a main shaft (2) extending through said housing at one end thereof, a low pressure gas inlet (4), a high pressure gas outlet (5), and inboard and outboard tandem gas seals (12, 13) for the main shaft at said one end of the compressor housing, wherein, in normal operation of the gas compressor (1), gas at a sealing pressure (SP) is supplied by the delivery pressure of the compressor (1) to the inboard gas seal (12) and, when the gas compressor is temporarily stopped and the inlet and outlet pressures are equalised to provide a residual delivery gas pressure (SOP), gas supplied by the residual delivery gas pressure of the compressor is introduced into the outboard gas seal (13) under conditions of temperature and pressure such as to prevent formation of condensate or freezing in the outboard and inboard gas seals (12, 13).

6. A method according to claim 5, wherein the gas introducted into the outboard gas seal when the gas compressor is temporarily stopped is heated to raise its temperature.

7. A method according to claim 5 or 6, wherein the gas pressure is reduced from its residual delivery gas pressure (SOP) before it is introduced into the outboard gas seal (13).

8. A method according to claim 5 or 6, wherein a gas flow to a flare from a gas chamber (17) between the inboard and outboard seals (12, 13) is throttled to maintain elevated gas pressure in said gas chamber and gas is supplied by the residual delivery gas pressure to the inboard seal, when the gas compressor is temporarily stopped.

9. A method according to claim 7, wherein a gas flow to a flare from a gas chamber (17) between the inboard and outboard seals (12, 13) is throttled to maintain elevated gas pressure in said gas chamber and gas is supplied by the residual delivery gas pressure to the inboard seal, when the gas compressor is temporarily stopped.

* * * * *